United States Patent [19]

Grieve et al.

[11] 4,403,727

[45] Sep. 13, 1983

[54] MULTI-COMPARTMENTED DISPLAY CARTON

[75] Inventors: Harold R. Grieve; Thomas S. Andersen, both of Battle Creek, Mich.

[73] Assignee: General Foods Corporation, White Plains, N.Y.

[21] Appl. No.: 362,179

[22] Filed: Mar. 26, 1982

[51] Int. Cl.[3] ..... B65D 5/48

[52] U.S. Cl. ..... 229/27; 229/28 R

[58] Field of Search ..... 229/27, 28 R, 15; 206/45.12, 45.19, 45.29

[56] References Cited

U.S. PATENT DOCUMENTS

| | | | |
|---|---|---|---|
| 2,913,101 | 11/1959 | Daily | 229/27 |
| 3,347,356 | 10/1967 | Kossnar | 229/27 |
| 3,366,305 | 1/1968 | Cohen | 229/28 R |
| 3,889,867 | 6/1975 | Berg | 229/28 R |
| 4,089,457 | 5/1978 | Wood | 229/28 R |
| 4,116,330 | 9/1978 | Ellis | 229/28 R |
| 4,213,559 | 7/1980 | Meyers | 229/27 |

*Primary Examiner*—Herbert F. Ross

*Attorney, Agent, or Firm*—Daniel J. Donovan; Thomas V. Sullivan; Thomas R. Savoie

[57] ABSTRACT

An open top, multi-compartmented display carton for the displaying and dispensing of upstanding pouches, envelopes or packets, and which includes a mechanically locking bottom wall structure, an apertured or windowed front wall, a back wall, two end walls and at least one partition extending between the front and back walls, with the entire carton structure being folded and glued from a single fiberboard blank. The bottom wall structure of the display carton includes four flaps which are hinged to the lower edges of four adjacent walls of the carton, and wherein at least three of the bottom flaps include tab structure adapted to interengage upon the flaps being superimposed when the carton is in a set-up or assembled condition, and wherein the tabs will form a mechanical locking structured assisted for retention in its locked condition by the weight of the packets located in the carton compartments. When the carton is collapsed into a flattened or knocked-down condition, the tabs on the bottom flaps will disengage to thereby allow the bottom flaps to fold down flat outwardly of the carton. Each carton partition consists of a flap cut out from the material of the front wall and the upper forward edge portion of an adjoining carton side wall and is adapted to be folded rearwardly into the carton so as to contact the interior surface of the carton back wall. The free end of each partition contacting the back wall includes a flap adapted to be glued to the interior surface of the back wall so as to form a multi-compartmented structure within the display carton. A plurality of superimposed filled cartons are frequently held together under a compressive load by a band or web of an encompassing layer of a transparent shrink wrap or stretch wrap film.

10 Claims, 7 Drawing Figures

MULTI-COMPARTMENTED DISPLAY CARTON

BACKGROUND OF THE INVENTION

1. Field of the Invention

The present invention relates to a multi-compartmented display carton, preferably constituted of fiber board, which is usually employed for the displaying and dispensing of thin product-containing envelopes, pouches or packets arranged on edge within the carton. Included among products which are displayed and merchandised in this manner are powdered concentrates for soft drinks, dried seasonings, soup or gravy mixes, and which are usually marketed in a wide variety of flavors. Generally, cartons of this type which are filled with such pouches or packets are frequently stacked upon one another and the packets are dispensed from the front of the cartons. These packets do not in themselves support the weight of an upper or superimposed carton, and it is the carton structure itself which prevents the lower carton from collapsing after the removal of a substantial portion of the packets contained therein. Moreover, during shipping, a plurality of such superimposed filled cartons are frequently held together under a compressive load by a band or web of an encompassing layer of a transport shrink wrap or stretch wrap film.

2. Discussion of the Prior Art

A non-collapsing display carton of this type is disclosed in Berg U.S. Pat. No. 3,889,867, issued June 17, 1975, which provides for a carton structure having a plurality of partitions forming a windowed multi-compartmented display carton for the displaying and dispensing of thin envelopes or packets which are arranged on edge within the carton, and wherein the partitions are formed from fiber board segments punched out from the material of the front and rear walls of the carton, folded inwardly of the carton and are thereafter glued together. Furthermore, the bottom wall structure consists of a number of panel sections hingedly connected to each of the carton side and end walls, which are glued together and adapted to fold inwardly into the carton when the latter is arranged in a folded flat or collapsed position. The display carton disclosed in the Berg U.S. Pat. No. 3,347,356, although basically providing for a satisfactory structure with regard to the display and dispensing of the thin envelopes or packets, however, is of a more complex and expensive construction than the display carton contemplated by the present invention. Thus, because the Berg carton requires a glued bottom wall structure in addition to the glued structure of the partitions and of the carton end and side wall along one edge thereof, necessitates the employment of a second gluing operation at right angles to the first gluing sequence which precludes the use of only a straight-line gluer for the inventive carton. The novel bottom carton panel configuration used herein saves additional fiber board material in comparison with Berg. Additionally, the elimination by the invention of the glued bottom and the novel configuration of the bottom flap structures allows for a simple but sturdy mechanical interlocking interengagement of the carton bottom panels and the assistance in such an interlocked bottom panel condition by the weight of the packets or envelopes which are stored in the carton compartments.

SUMMARY OF THE INVENTION

In essence, the present invention thus consists of an open top, multi-compartmented display carton for the displaying and dispensing of upstanding pouches, envelopes or packets, and which includes a mechanically locking bottom wall structure, an apertured or windowed front wall, a back wall, two end walls and at least one partition extending between the front and back walls, with the entire carton structure being folded and glued from a single fiberboard blank. The bottom wall structure of the display carton includes four flaps which are hinged to the lower edges of four adjacent walls of the carton, and wherein at least three of the bottom flaps include tab structure adapted to interengage upon the flaps being superimposed when the carton is in a set-up or assembled condition, and wherein the tabs will form a mechanical locking structure assisted for retention in its locked condition by the weight of the packets located in the carton compartments. When the carton is collapsed into a flattened or knocked-down condition, the tabs on the bottom flaps will disengage to thereby allow the bottom flaps to fold down flat outwardly of the carton.

Each carton partition consists of a flap cut out from the material of the front wall and the upper forward edge portion of an adjoining carton side wall and is adapted to be folded rearwardly into the carton so as to contact the interior surface of the carton back wall. The free end of each partition contacting the back wall includes a flap adapted to be glued to the interior surface of the back wall so as to form a multi-compartmented structure within the display carton.

The partitions which are cut out from the front wall may have notches or cutouts formed therein so as to leave a tab or protuberance in the plane of the front wall which protrudes across the opening or window formed in the front wall ahead of some of the compartments to thereby prevent displayed packets stored therein from toppling forwardly out of the display carton. Moreover, a plurality of the display cartons of the present invention may be stacked or superimposed filled with product-containing packets to facilitate the concurrent display and dispensing of different types of products and/or of similar products having various flavors.

Accordingly, it is a principal object of the present invention to provide a multi-compartmented display carton of the above-described type which can be produced in a simple and inexpensive manner, while being of great strength and adapted to facilitate the attractive display of and the dispensing of packets, pouches or envelopes containing various kinds of products.

BRIEF DESCRIPTION OF THE DRAWINGS

Reference may now be had to the following detailed description of an exemplary embodiment of a display carton constructed pursuant to the invention, taken in conjunction with the accompanying drawings; in which.

DETAILED DESCRIPTION

Figure 1:
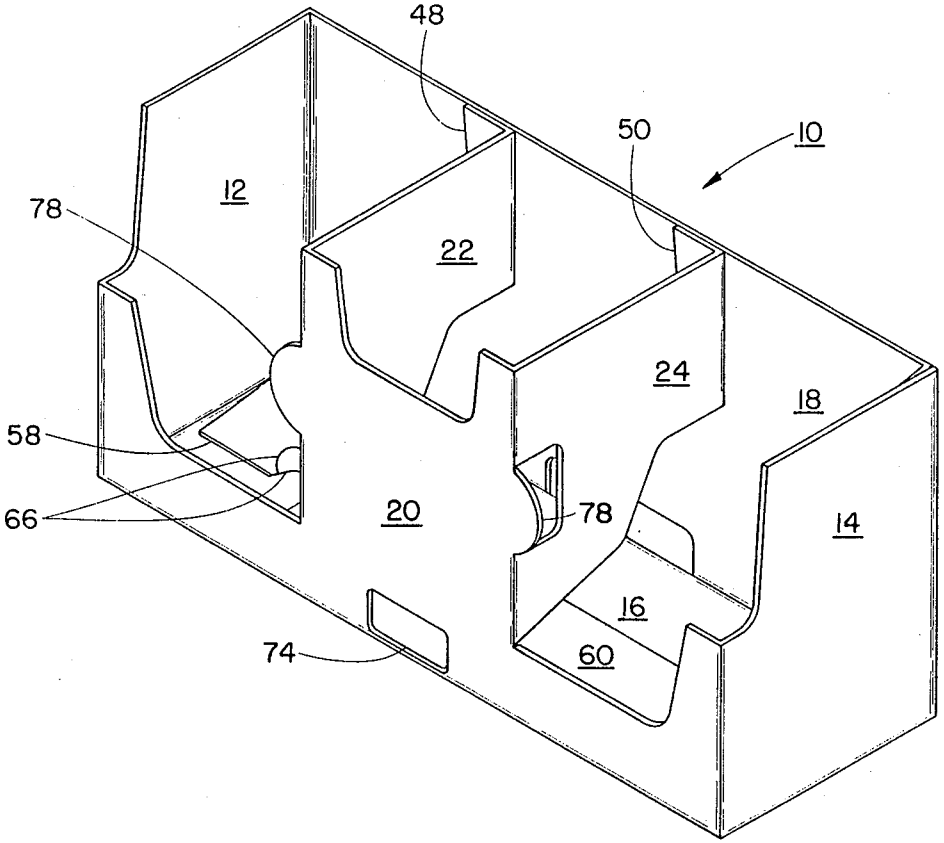
FIG. 1 illustrates a perspective view of a preferred embodiment of the display carton pursuant to the invention, with the carton being shown in the set-up condition ready to receive a supply of pouches, envelopes or packets.

Referring now in detail to the drawings, as is illustrated in FIG. 1 the empty set-up display carton 10 includes upstanding end walls 12 and 14, a bottom wall structure 16, an upstanding back wall 18, an apertured or windowed upstanding front wall 20, and two substantially similar compartment forming partitions 22 and 24. As shown, the interior of the display carton is subdivied into three generally rectangular compartments by the partitions 22 and 24, each compartment being opened at the top and having the front wall 20 provided with substantial cut away portions to provide for frontal access and viewing of the products stored in the compartments.

Figure 2:
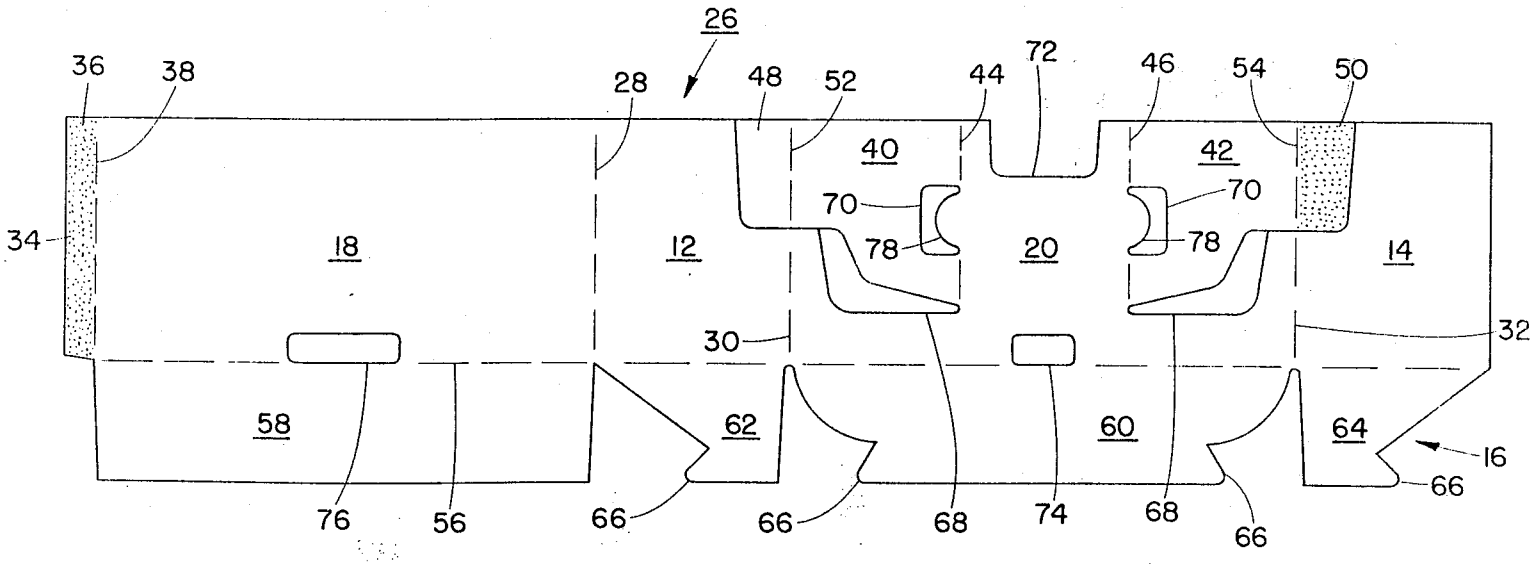
FIG. 2 illustrates a plan view, as viewed from the exterior or printed side of the carton, of an unfolded cut and creased fiberboard blank for forming the display carton of FIG. 1.

Having reference to FIG. 2 of the drawings, this discloses a blank 26 for forming the display carton 10 of FIG. 1, with the carton walls 18, 12, 20 and 14 being, respectively, joined together along fold or crease lines 28, 30 and 32, and with an end flap 34 on the wall 18, having a glued surface 36, foldable along fold line 38 and being glued to the interior surface of side wall 14 so as to form a closed rectangular structure in the set-up condition of the display carton. The partition walls 40 and 42 which are die cut out of the front wall 20 and the upper front edge portions of side walls 12 and 14, are adapted to be folded inwardly of the carton along crease lines 44 and 46 so as to extend rearwardly in parallel spaced relationship with the side walls 12, 14 into contact with the inner surface of the back wall 18; and incorporate flaps 48 and 50, which are generally formed by the material of the upper front edge portions of its side walls 12 and 14, foldable along crease lines 52 and 54 so as to allow the flaps to be glued to the interior of the rear wall 18 by means of suitable glue applied to the front surface of the flap 50 and the rear surface of flap 48. If desired, the glue may be applied to the front surface of flap 48 rather than the rear surface thereof, and the flap 48 is then folded in the opposite direction to that shown in FIG. 1 of the drawings.

The bottom wall flap structure 16 is foldable relative to the upstanding carton walls 12, 14, 18 and 20 along a fold or crease line 56. In essence, the bottom wall structure 16 includes a generally rectangular flap 58 formed along the bottom edge of back wall 18, an elongate flap 60 formed along the bottom edge of front wall 20, and two smaller flaps 62 and 64 each formed along, respectively, the bottom edges of end walls 12 and 14. The flaps 62, 60 and 64 each incorporate projecting, somewhat V-shaped or nose-like tab portions 66 which are adapted to interengage beneath flap 58 and each other when the bottom wall structure 16 of the display carton 10 is folded inwardly in the erected position of the carton. This interengagement of the tabs 66 will produce a mechanical interlocking of the flaps of the carton bottom wall structure 16, such interlocking action being enhanced when the display carton is filled with pouches, packets or envelopes filled with product. This will effectively eliminate the necessity for a glued bottom carton construction and render the structure much more simple and economical.

The carton blank as illustrated in FIG. 2 may include various cutouts 68 and 70 to improve performance of carton during glueing and setup operations. Moreover, in order to provide access to or view of the product packets within the display carton, the front wall 20 may also be provided with a cutout 72 and a cutout 74. If desired, the carton back wall 18 may have cutout 76 formed therein to allow for the insertion of a bracket for suspending the carton in its display position.

As illustrated in FIGS. 1 and 2, the flaps 48 and 50 for gluing the partitions 40 and 42 to the interior surface of the back wall 18 are die cut of, respectively, the upper front corners or edge portions of the side walls 12 and 14 which, although occasioning the removal of a portion of the upper edge plane of the display carton 10 at these corners, will not unduly reduce the supportive strength of the carton inasmuch as the central portion of the front wall 20 includes upstanding corners formed along the crease line 44 and 46 which will support a further carton 10 superimposed thereon, in addition to the full length of the back wall 18 and the major portions of the side walls 12 and 14 which extend the full height of the carton.

In order to prevent packets from falling or tipping forwardly out of the front of the compartments, particularly from the two end compartments of the display carton, the cutouts 70 in the front wall 20 are shaped to provide for the retention of protuberances or rounded tabs 78 which will form front wall surface extensions ahead of the end compartments aiding in restraining the packets within the compartments.

Figure 3:
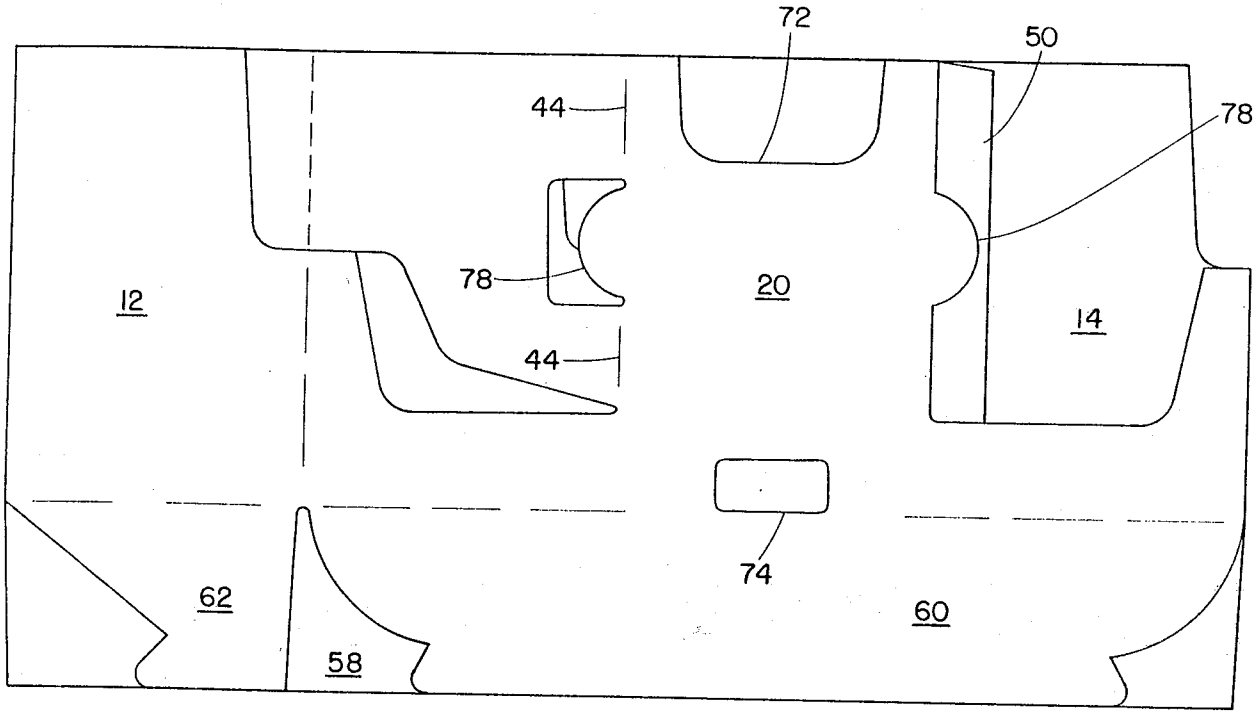
FIG. 3 illustrates a front elevational view of the assembled, glued carton of FIG. 1 in its knocked-down condition with its mechanically locking bottom wall flap structure folded downwardly and outwardly of the carton.

FIG. 3 illustrates the carton 10 of FIG. 1 in the glued and collapsed condition which renders it suitable for shipping in large quantities in an empty condition. In this instance, the tabs 66 of the bottom wall structure 16 have been disengaged to permit the folding down and out of the bottom wall structure 16 and with the carton being folded together along the vertical crease or fold line 28, 30, 52, 44, 46, 32, and 54. This will allow for the folding flat or knocking down of the display carton without detaching any of the glued surfaces, and thereby will facilitate maintenance of the integrity of the carton for subsequent set-up and filling.

Figure 4:
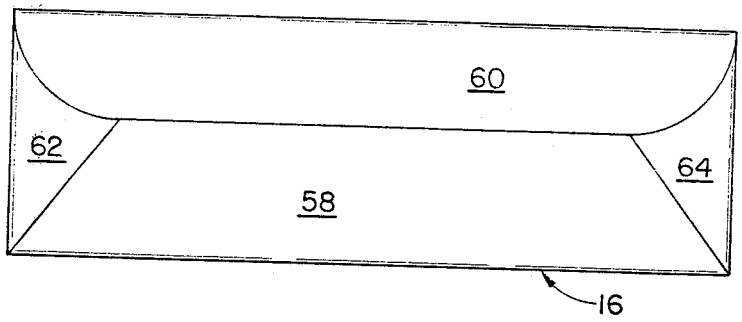
FIG. 4 illustrates a bottom plan view of the carton in its set-up condition with the bottom wall flap structure having the locking tabs in their interengaged condition.

FIG. 4 of the drawing shows a bottom view of the display carton in the set-up position of the carton with the bottom flaps 62 and 64 being tucked beneath bottom flap 58, and thereafter bottom flap 60 being tucked above flaps 62 and 64 and beneath flap 58 so as to cause the various tab portions 66 to interengage the edges of the respectively adjacent flaps and to thereby form a mechanical locking arrangement for the bottom structure 16 which will obviate the necessity for gluing, as is the case in the prior art. This will eliminate the need for any gluing apparatus besides a single straight-line gluer.

Figure 5:
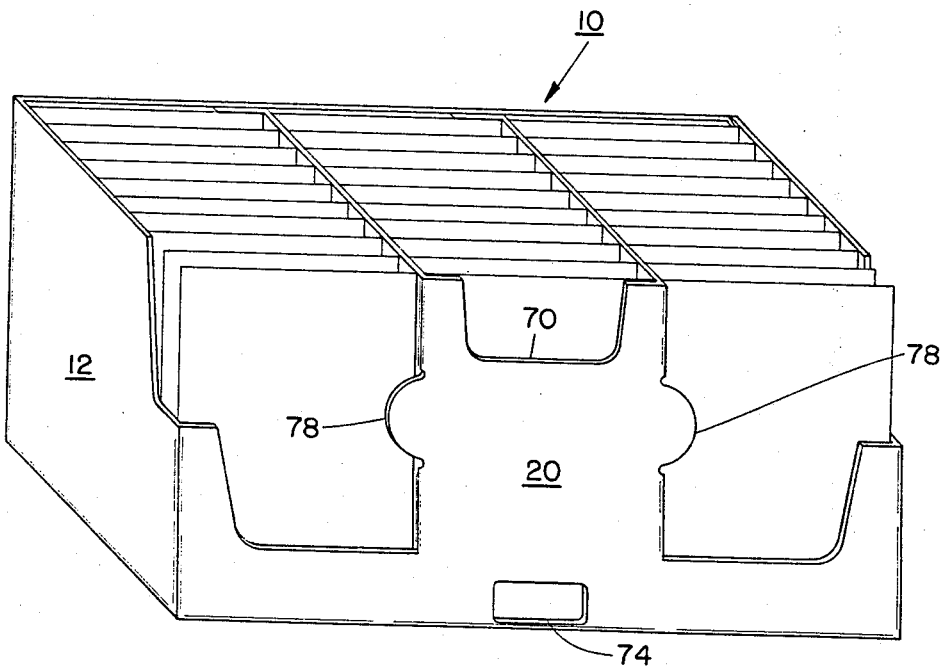
FIG. 5 illustrates a front perspective view of the carton showing it in the filled condition thereof.

The display carton of FIG. 1 is illustrated in FIG. 5 with the packets being stacked upright or vertically in the compartments which are formed intermediate the end walls 12 and 14 and the partitions 22, 24. Because of the cutouts which are formed in the front wall 20, the packets in the compartments are clearly visible to a customer from the front of the display carton and can be pulled out by being grasped along their upper edges and pulled forwardly and upwardly.

Figure 6:
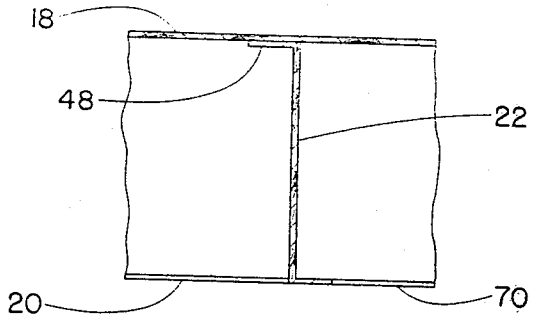
FIG. 6 is a detailed fragmentary sectional view taken along line of the partitions and the adjoining front and back wall portion of the display carton.

FIG. 6 illustrates a detail of the top of the partition 22 extending rearwardly across the display carton from the front wall 20 to the back wall 18, with the flap 48 being glued to the inner surface of back wall 18 so as to form the compartmented structure.

Figure 7:
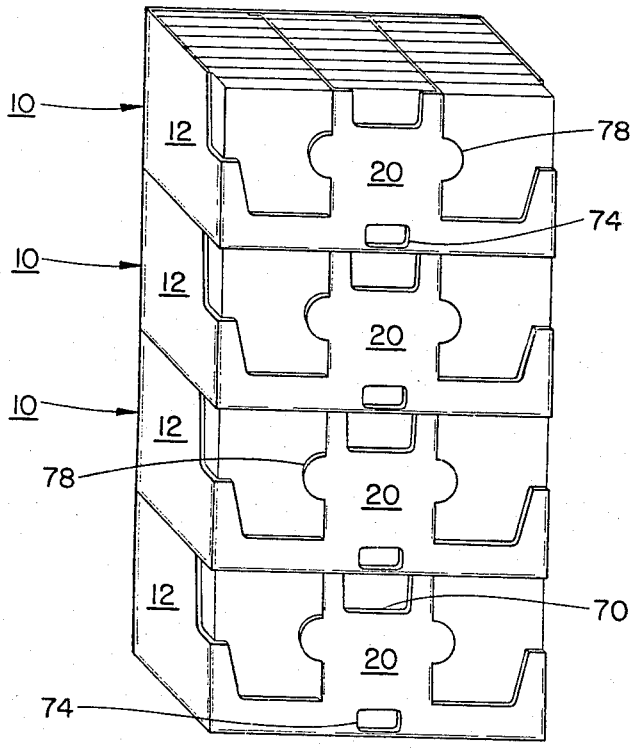
FIG. 7 is a perspective view of a plurality of superimposed display cartons similar to those in FIG. 1, shown in a reduced scale in a filled and stacked condition, and wherein each carton compartment is adapted to contain packets filled with differently flavored products and/or different types of products.

Referring in particular to FIG. 7 of the drawings, this shows a plurality of packet-filled display cartons 10 in a tiered or stacked position with each display carton, if desired, providing for different flavors or types of products in the various packets stored in the different compartments so as to afford a large product selection to a prospective customer. During shipping of filled, stacked display carton, the entire carton assembly may be encompassed by an overwrap film, either a transparent stretch wrap or shrink wrap film.

While there has been shown and described what is considered to a preferred embodiment of the invention, it should be understood that modification in form and detail can be made without departing from the spirit or essence of the invention. It is therefore intended that the invention be not limited to the exact form and detail herein shown and described nor to anything less than the whole of the invention as hereinafter claimed.

What is claimed is:

1. A foldable multi-compartment display carton including front and back side walls; two opposite end walls; a bottom wall structure; and at least one partition extending in spaced parallel relationship to said end walls so as to form said compartments, each said partition comprising a flap cut out from portions of said front side wall and end walls to provide full height corners between the back side wall and end walls and between the front side wall and said flap, said flap being glued to said back side wall, and said front, back and end walls and partitions having at least a portion of their top edges extending in a horizontal plane at the same maximum height extending above said bottom wall structure.

2. A display carton as claimed in claim 1, said bottom wall structure comprising four bottom wall panels, each being formed onto the bottom edge of a respective wall of said carton structure and being foldable about said edge, at least some of said bottom wall panels including locking tab portions engageable with adjacent located bottom wall panels in the set-up position of the carton so as to form a mechanically locking bottom wall structure.

3. A display carton as claimed in claim 2 said bottom wall structure being downwardly and outwardly foldable about said edge upon said display carton being collapsed into a flattened condition.

4. A display carton as claimed in claim 1 or 2, said back side wall, at least portions of said end walls, of said front side wall and of said flaps adjoining said front side wall being equal in height so as to define an upper edge plane extending in parallel with the bottom wall structure, said carton having a height in excess of the height of upright packets being displayed whereby the weight of superimposed filled cartons is assumed by the carton along the coplanar carton edges rather than by the packets stored within the cartons.

5. A display carton as claimed in claim 1, said carton having an open top for filling said packets into said carton from the top of said carton.

6. A display carton as claimed in claim 1, wherein the front side wall of said carton includes cutouts formed therein providing openings to allow for ready access to packets stored therein from the front of said carton.

7. A display carton as claimed in claim 6, each said partition formed from said front side wall having a protuberance cut from the partition remaining in the plane of said front side wall, said protuberance extending across the openings formed said front side wall in front of the end compartments so as to prevent packets displayed in said compartments from forwardly tipping out of said carton.

8. A display carton as claimed in claim 1, comprising a plurality of set-up cartons being arranged in a superimposed position; and transparent overwrap film means encompassing said cartons.

9. A display carton as claimed in claim 8, said film means being a stretch-wrap film.

10. A display carton as claimed in claim 8, said film means being a shrink-wrap film.

* * * * *